US005693458A

United States Patent [19]

Clark et al.

[11] Patent Number: 5,693,458

[45] Date of Patent: Dec. 2, 1997

[54] PHOTOGRAPHIC ELEMENTS CONTAINING CERTAIN YELLOW DYE-FORMING COUPLERS

[75] Inventors: Bernard Arthur Clark, Maidenhead; Robert Nicholas Gourley, Aylsebury; Hamish McNab, Edinburgh; Craig Cameron Sommerville, Crossroads, all of United Kingdom

[73] Assignee: Eastman Kodak Company, Rochester, N.Y.

[21] Appl. No.: 669,194

[22] Filed: Jun. 24, 1996

[30] Foreign Application Priority Data

Jun. 28, 1995 [GB] United Kingdom ..... 9513108

[51] Int. Cl.[6] ..... G03C 7/32

[52] U.S. Cl. ..... 430/557; 430/556

[58] Field of Search ..... 430/556, 557

[56] References Cited

U.S. PATENT DOCUMENTS 2,184,303 12/1939 Jennings ..... 430/556
2,331,326 10/1943 Kendall et al. ..... 95/6

FOREIGN PATENT DOCUMENTS 603995 5/1961 Belgium .
0372470 6/1990 European Pat. Off. .
4330105 3/1995 Germany .
1237656 9/1989 Japan ..... 430/557

OTHER PUBLICATIONS

Synthesis, 1993, Stuttgart, DE, pp. 783–785, R. Bossio et al. "Studies on Isocyanides and Related Compounds".

Journal of General Chemistry USSR, vol. 30, No. 10, Oct. 1960, NY US N.S. Vulf'son and V.E. Kolchin.

Journal of Medicinal Chemistry, vol. 36, 1993, Washington US, pp. 3386–3396, M. Rowley et al.

*Primary Examiner*—Janet C. Baxter
*Attorney, Agent, or Firm*—Arthur E. Kluegel

[57] ABSTRACT

The invention provides a photographic element comprising a light-sensitive silver halide emulsion layer having associated therewith a dye-forming coupler of formula (I):

(I)

wherein X is H or a coupling-off group, $R_1$ is H or a substituent group; Y and Z are the same or different and are H or are independently selected from alkyl, aryl and heteroaryl groups; provided that Y and Z taken together with the nitrogen atom may form a 5–10 membered heterocyclic ring.

19 Claims, No Drawings

PHOTOGRAPHIC ELEMENTS CONTAINING CERTAIN YELLOW DYE-FORMING COUPLERS

FIELD OF THE INVENTION

The present invention relates to photographic elements containing yellow dye-forming couplers where the couplers contain a thenoyl group.

BACKGROUND OF THE INVENTION

Photographic layers sensitive to blue light for use in a color photographic material typically contain a yellow coupler which, on reaction with an oxidised p-phenylenediamine developer, forms a yellow dye. At the time of writing, most commercially available photographic films contain pivaloyl or benzoyl acetanilide yellow couplers. These classes of couplers are not entirely satisfactory, and a person skilled in the art will be aware that even the best examples of these classes are a compromise between coupler activity as measured, for example, by contrast on the one hand and dye stability on the other. Dodecyl 4-chloro-3-[2-(1-benzyl-5-ethoxy-2,4-dioxoimidazolidin-3-yl)-2-(2,2-dimethylpropanoyl)acetamido]benzoate, for example, has good dye stability, but has a relatively poor contrast; dodecyl 4-chloro-3-[2-(1-benzyl-5-ethoxy-2,4-dioxoimidazolidin-3-yl)-2-(4-methoxybenzoyl)-acetamido]benzoate, on the other hand, has a relatively good contrast but has poor dye stability.

There is, therefore, a desire to find classes of yellow couplers which depend on a different nucleus structure. In each new class discovered, there is a chance that one or more examples may exhibit a combination of parameters which is better than the yellow couplers hitherto available in the art.

SUMMARY OF THE INVENTION

The invention provides a photographic element comprising a light-sensitive silver halide emulsion layer having associated therewith a dye-forming coupler of formula (I):

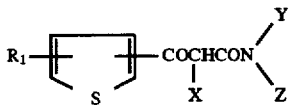

(I)

wherein X is H or a coupling-off group, $R_1$ is H or a substituent group; Y and Z are the same or different and are H or are independently selected from alkyl, aryl and heteroaryl groups; provided that Y and Z taken together with the nitrogen atom may form a 5–10 membered heterocyclic ring.

The present invention also includes the coupler itself, and a process for forming an image in an element of the invention.

The inventive element exhibits photographic properties comparable to those of known photograpic elements having conventional couplers.

DETAILED DESCRIPTION OF THE INVENTION

The scope of the invention is described in the Summary of the Invention. The formulas of the invention may contain substituents as described hereinafter. In the formula I, the proviso describing a heterocyclic ring formed by Y and Z, it is contemplated that the heterocyclic ring may contain one or more further heteroatoms selected from N, O and S.

In a preferred aspect of the present invention there is provided a yellow coupler of formula (II):

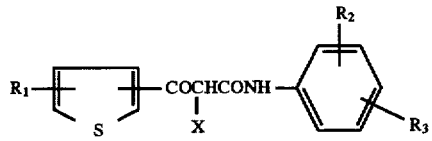

(II)

wherein X is H or a coupling-off group; and $R_1$, $R_2$ and $R_3$, independently, are selected from H and substituent groups.

The coupling-off group is a group adapted to split-off from the coupler as a result of the reaction between the coupler and the oxidation product of an arylamine color developer. Usually the substituent groups are coupler-modifying groups which, by their presence in the coupler structure, influence the photographic or physical properties of the coupler or the dye derived from the coupler. The effect may be to increase reactivity, to prevent diffusibility, to improve the stability of the coupler or dye, or to improve the hue, for example.

The yellow coupler may be a then-2-oylacetanilide of formula (III):

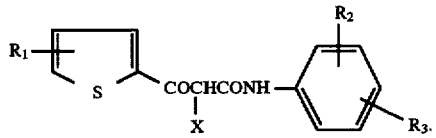

(III)

Alternatively, the yellow coupler may be a then-3-oylacetanilide of formula (IV):

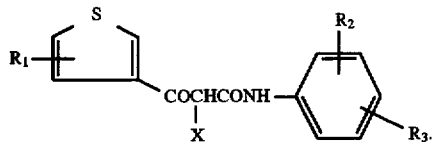

(IV)

Typically, $R_1$, $R_2$ and $R_3$ may be selected, independently, from H, coupler-solubilising groups, ballasting groups and dye hue-modifying groups. $R_1$, $R_2$ and $R_3$ may be selected from H, halogen, alkyl, aryl, heteroaryl, carboxylic acid, alkoxycarbonyl, aryloxycarbonyl, primary or secondary alkyl- or aryl- amido, alkyl- or aryl- sulfonamido, primary, secondary or tertiary amino, alkoxy, aryloxy, acyloxy, alkyl- or aryl- carbamoyl, alkyl- or aryl- sulfamoyl, alkyl- or aryl-sulfonyl and alkyl- or aryl- sulfonyloxy groups. In one aspect of the present invention, at least one of $R_1$, $R_2$ and $R_3$ may contain at least six carbon atoms. Any of the above substituents of $R_1$, $R_2$ and $R_3$, other than H and halogen, may be substituted with one or more of the same or different substituents of $R_1$, $R_2$ and $R_3$ as hereinabove defined.

Typically, $R_1$ may be selected from H, and halogen, alkyl, alkoxy, alkysulfonyloxy, alkylsulfonamido and alkoxycarbonyl groups. In one embodiment, $R_1$ may be H. In another embodiment, the coupler may be a then-2-oylacetanilide of formula (III) and $R_1$ may be a methoxy group; alternatively $R_1$ may be methyl, hexadecylsulfonyloxy, hexadecylsulfonamido or a dodecyloxycarbonyl group.

Typically, $R_2$ may be halogen, alkoxy or a trifluoromethyl group. In one embodiment, $R_2$ may be ortho-chloro. In a different aspect of the invention, $R_2$ may be an ortho-methoxy group.

In one aspect of the present invention, $R_3$ may be a coupler-solubilising or coupler-ballasting functional group. Typically, $R_3$ may be a carboxy-ester group. In one embodiment, $R_3$ may be dodecyloxycarbonyl or hexadecyloxycarbonyl group. Alternatively, $R_3$ may be an alkyl sulfonamide group such as, for example, N-dodecylsulfonamide or N-hexadecyl-sulfonamide. In a different aspect of the invention, $R_3$ may be an N-amidophenylether group such as, for example, 3-(2,4-di-tert- pentylphenoxy)butanoylamino.

In a further aspect of the invention, $R_3$ may be an alkylsulfonyloxy group, such as, for example, hexadecyl-sulfonyloxy. In yet a further aspect, $R_3$ may be an alkylaminosulfonyl group, such as, for example, dodecylaminosulfonyl.

It will be appreciated that X may be H or any coupling-off group known to a person skilled in the art. In some embodiments, X may be selected from halogen, acyloxy, sulfonyloxy, aryloxy, heteroaryloxy, arylthio, heteroarylthio, urethane, imido, 2,4-oxazolidinedione, pyridone, pyridazone, phthalimido, succinimido, hydantoinyl, triazole, triazoledione, tetrazole, imidazole, pyrazole and benzotriazole groups.

In some embodiments, X may be chloro. Alternatively, X may be, for example, a hydantoinyl group, substituted with benzyl, alkoxy or alkyl, preferably 1-benzyl-5-ethoxyhydantoin-3-yl. In other embodiments, X may be a phenoxy group substituted, for example, with alkylsulfonyl or aryl-sulfonyl, preferably p-methyl-sulfonylphenoxy, p-benzyloxyphenylsulfonylphenoxy and p-hydroxyphenylsulfonyl-phenoxy. In one aspect of the invention, X may be dialkyl substituted oxazolidine-dione, preferably 5,5-dimethyl-2,4-oxazolidinedione.

In some embodiments, the dye-forming coupler of the invention may be selected from the following couplers:

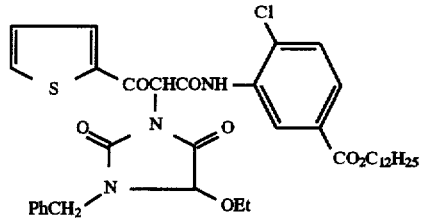

Coupler 1

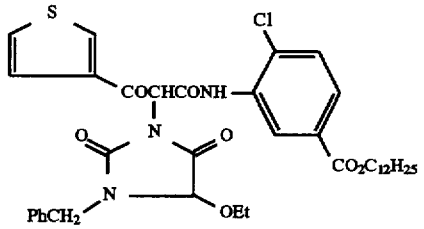

Coupler 2

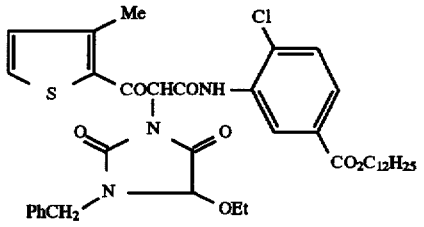

Coupler 3

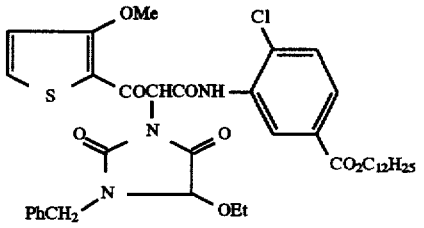

Coupler 4

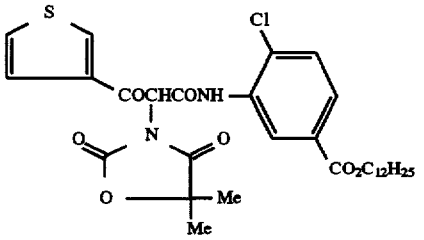

Coupler 5

-continued
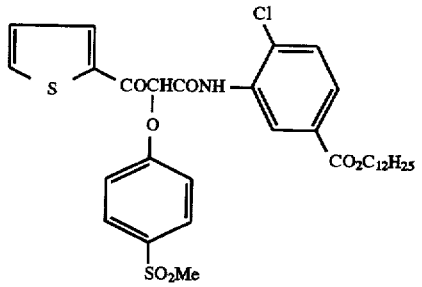
Coupler 6
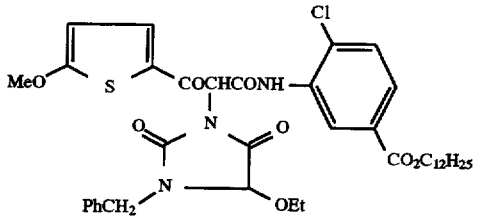
Coupler 7
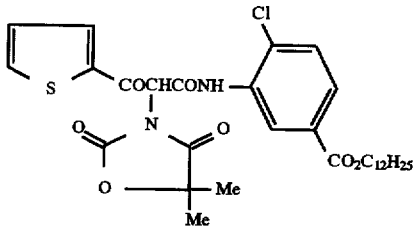
Coupler 8
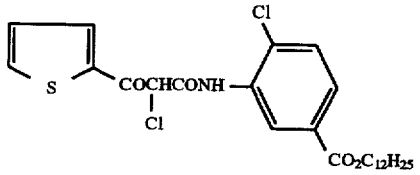
Coupler 9
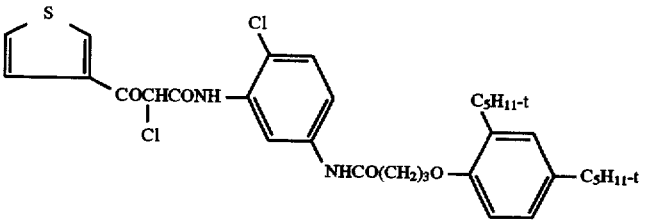
Coupler 10
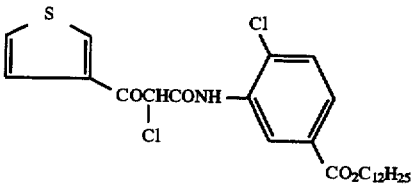
Coupler 11
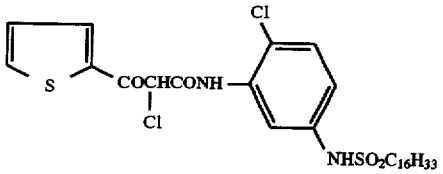
Coupler 12

-continued
Coupler 13
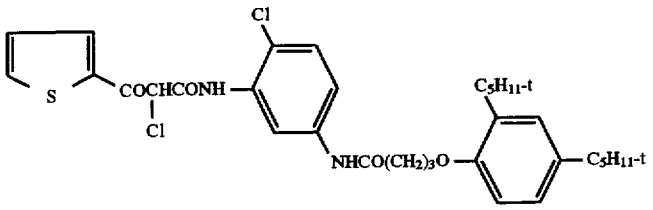
Coupler 14
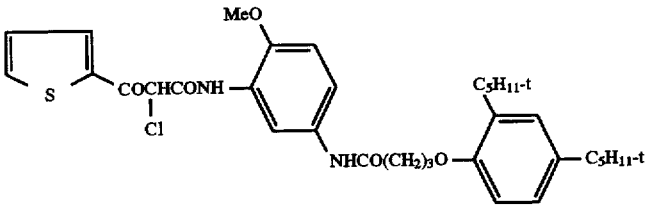
Coupler 15
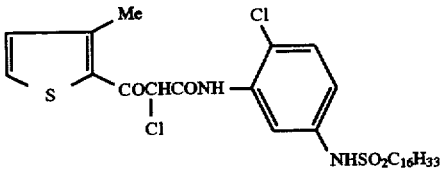
Coupler 16
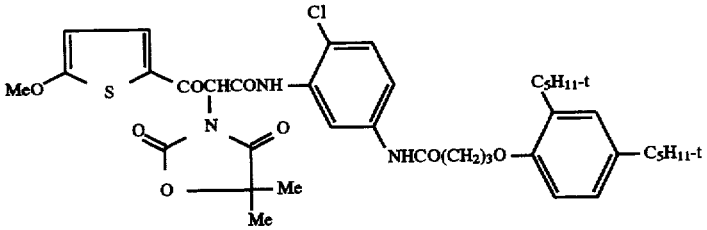
Coupler 17
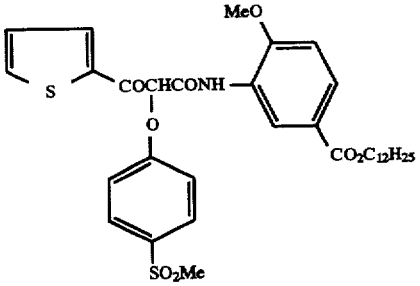
Coupler 18
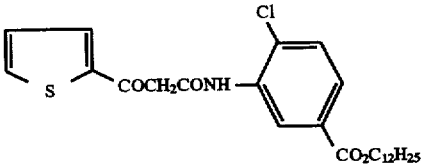
Coupler 19
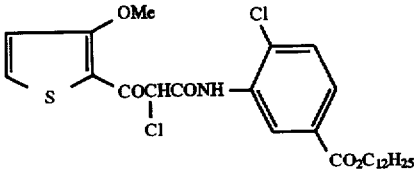

-continued
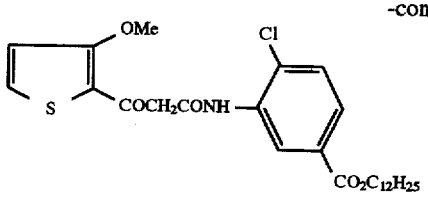
Coupler 20
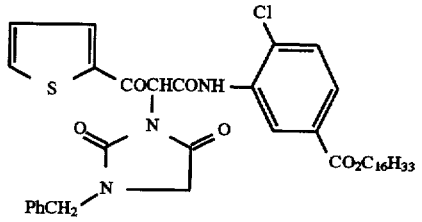
Coupler 21
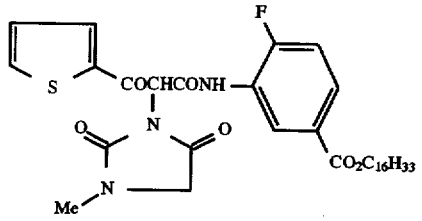
Coupler 22
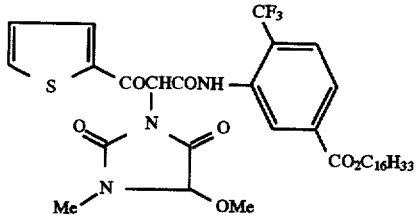
Coupler 23
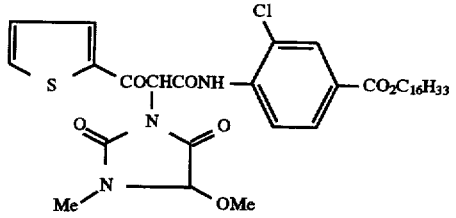
Coupler 24
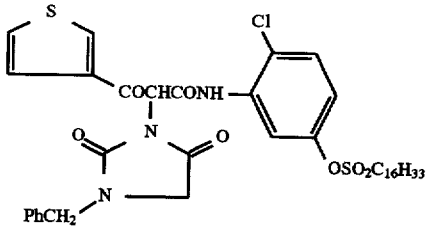
Coupler 25
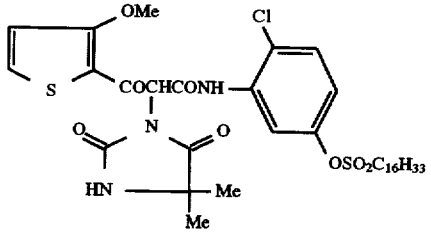
Coupler 26

-continued
Coupler 27
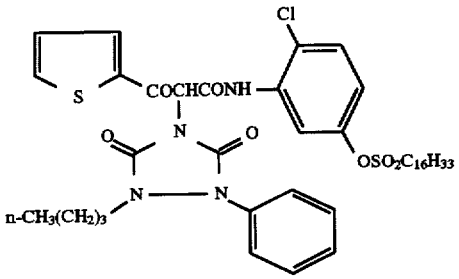
Coupler 28
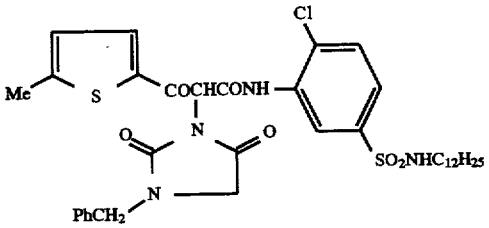
Coupler 29
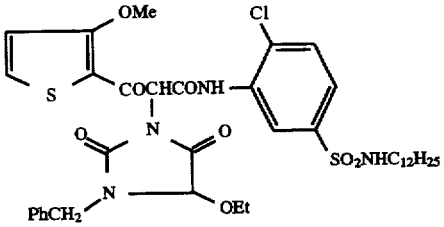
Coupler 30
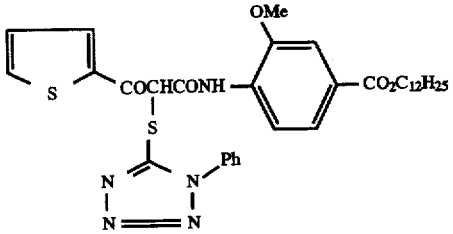
Coupler 31
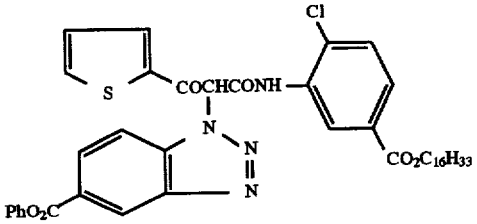
Coupler 32
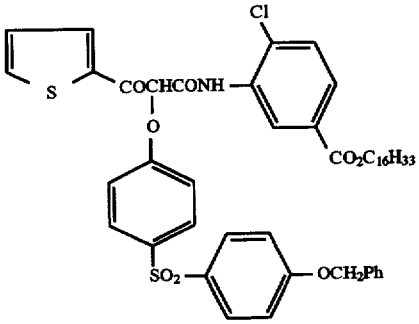

-continued
Coupler 33
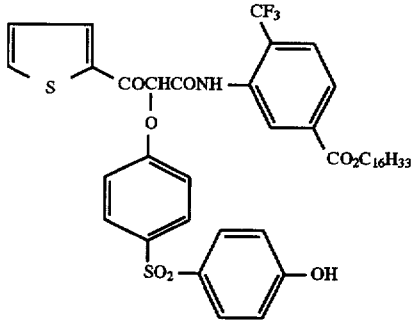
Coupler 34
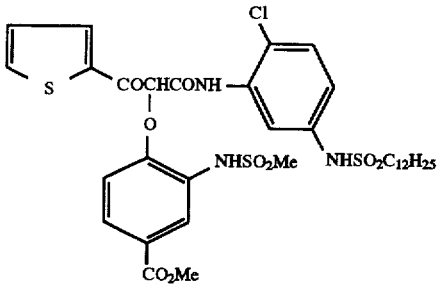
Coupler 35
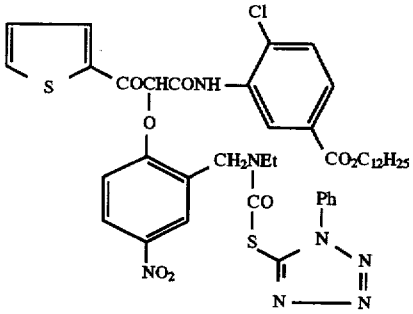
Coupler 36
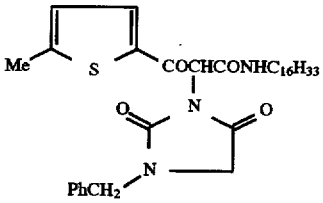
Coupler 37
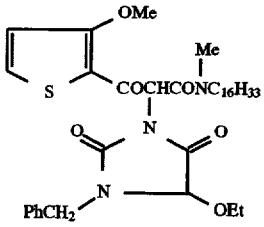
Coupler 38
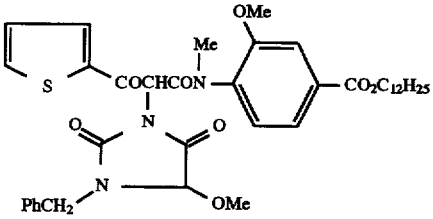

-continued

Coupler 39

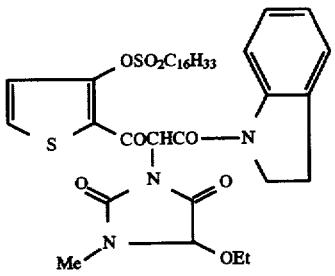

Coupler 40

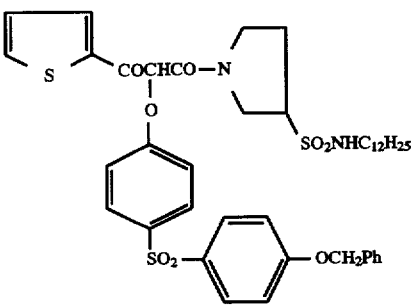

Coupler 41

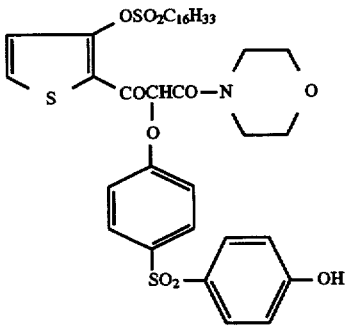

Coupler 42

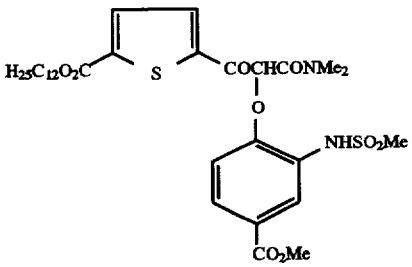

Coupler 43

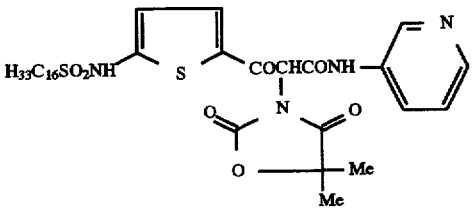

The yellow coupler in accordance with the invention may be used in combination with other classes of image couplers such as 3-acylamino- and 3-anilino-5-pyrazolones and heterocyclic couplers (e.g. pyrazoloazoles) such as, for example, those described in EP 285,274, U.S. Pat. No. 4,540,654 and EP 119,860; and other 5-pyrazolone couplers containing different ballasts or coupling-off groups such as, for example, those described in U.S. Pat. No. 4,301,235, U.S. Pat. No. 4,853,319 and U.S. Pat. No. 4,351,897. Yellow or cyan colored couplers (e.g. to adjust levels of interlayer correction) and/or masking couplers such as, for example, those described in EP 213,490, Japanese Published Application 58–172,647, U.S. Pat. No. 2,983,608, German Application DE 2,706, 117C, U.K. Patent 1,530,272, Japanese Application A-113935, U.S. Pat. No. 4,070,191 and German Application DE 2,643,965 may also be used. Said masking couplers may be shifted or blocked.

Unless otherwise specifically stated, "substituents" or substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy) hexanamido, alpha-(4-hydroxy-3-t-butylphenoxy) tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, Nov. 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Pat. Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, Feb. 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of a coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Pat. No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat.

No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58–113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent No. 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

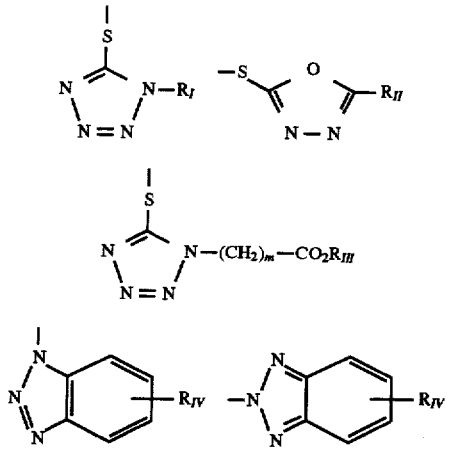

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

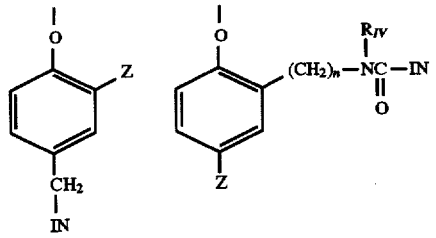

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

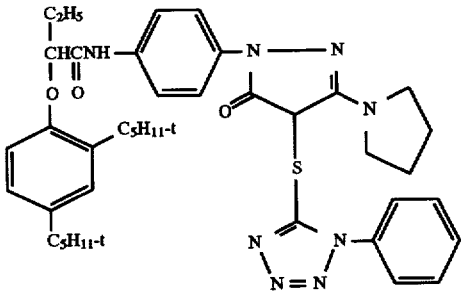

D2

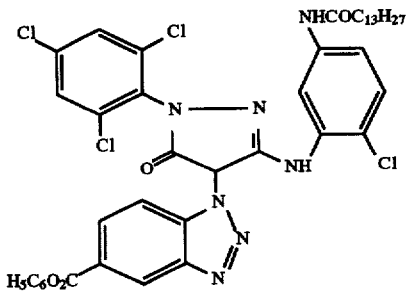

D3

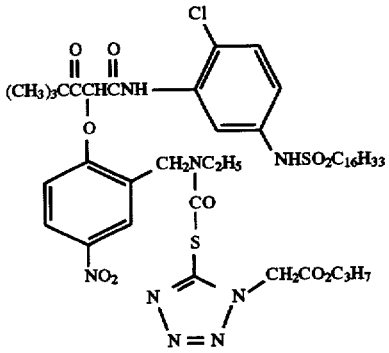

-continued

D4

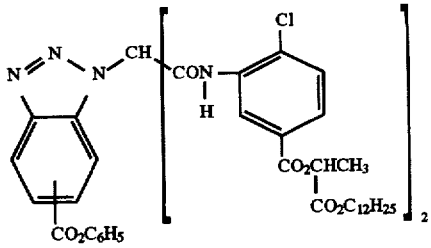

D5

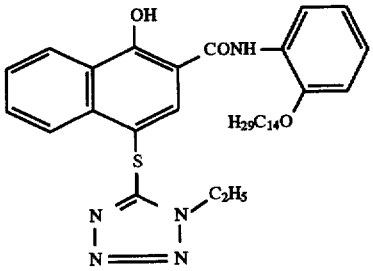

D6

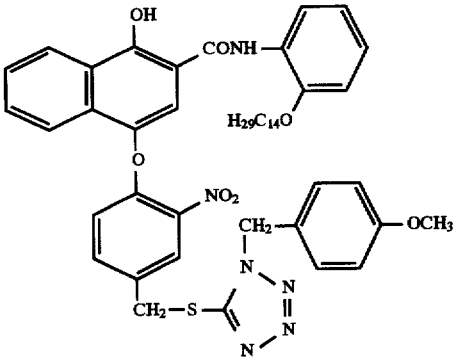

D7

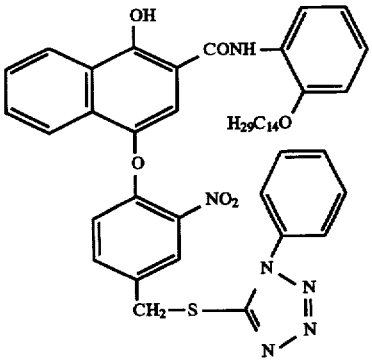

D8

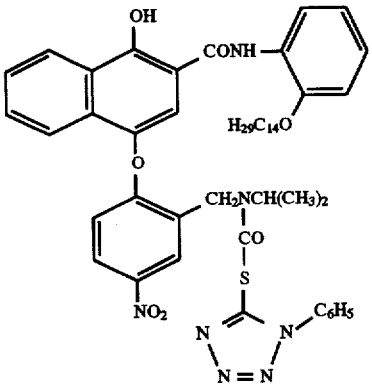

-continued

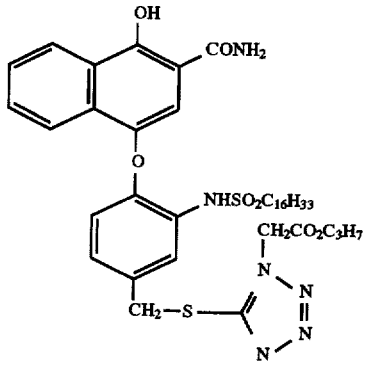

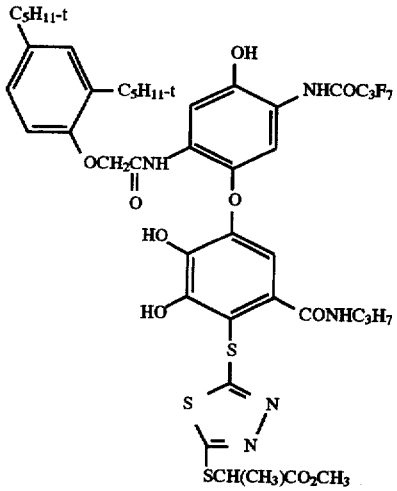

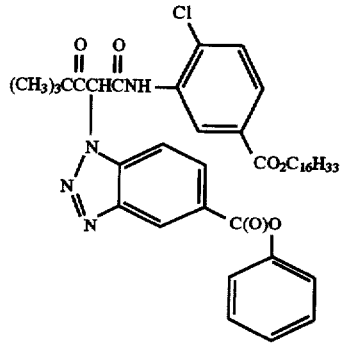

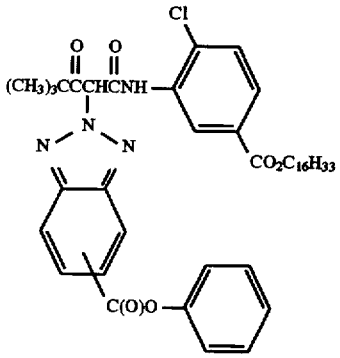

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072 629, 90-072,630; 90-072 631; 90-072 632; 90-072 633; 90-072 634; 90-077 822; 90-078 229; 90-078 230; 90-079 336; 90-079 337; 90-079 338; 90-079 690; 90-079 691; 90-080 487; 90-080 488; 90-080 489; 90-080 490; 90-080 491; 90-080 492; 90-080 494; 90-085 928; 90-086 669; 90-086 670; 90-087 360; 90-087 361; 90-087 362; 90-087 363; 90-087 364; 90-088 097; 90-093 662; 90-093 663; 90-093 664; 90-093 665; 90-093 666; 90-093 668; 90-094 055; 90-094 056; 90-103 409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of element is designed for image capture. In such an element, speed (the sensitivity of the element to light) is critical to obtaining sufficient image. Such elements may also include masking couplers and other information components since the element is not for direct viewing. These described elements are typically processed in the known Kodak C-41 color process as described in The British Journal of Photography Annual of 1988, pages 191–198. Another type of element is a color print comprising a viewable image on a reflective support. The appearance of the ultimate image rather than the light sensitivity is the major consideration for such an element. Such a print element may be processed in accordance with color print processes such as the RA-4 process of Eastman Kodak Company as described in the British Journal of Photography Annual of 1988, Pp 198–199. Normally, an image capture element of the type first described is optically printed onto a color print element of the second type described.

Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Synthesis Examples

Couplers 1, 9 and 18 were synthesized as illustrated by the following sequence, starting from 2-acetyl-thiophene.

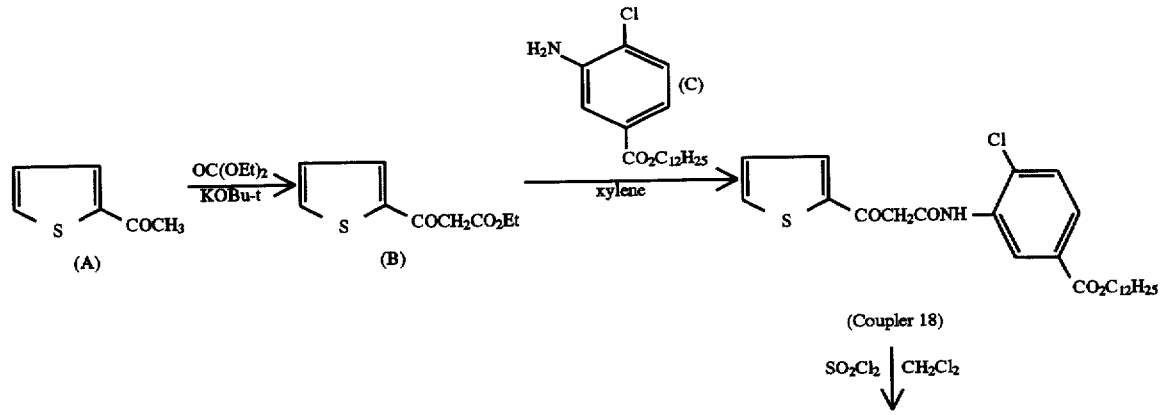

-continued

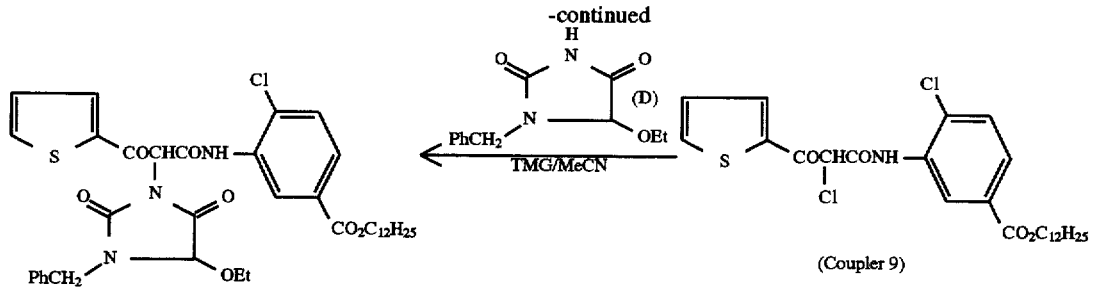

EXAMPLE 1

Synthesis of Coupler 18

1) Preparation of Intermediate (B)

Potassium t-butoxide (40.0 g, 0.357 mol) was added in portions over 10 minutes to a stirred solution of diethyl carbonate (106.0 g, 0.915 mol) maintaining the temperature at 60° C. The mixture was stirred at 60°–65° C. for 30 minutes then a solution of commercially available 2-acetylthiophene (A) (28.0 g, 0.222 mol) in dry toluene (50 ml) was added over 10 minutes keeping the temperature at 70°–75° C. More toluene (50 ml) was added and the mixture was stirred at 75–80° C. for 45 minutes before being left to cool to 25° C. The mixture was shaken with water (400 ml) and ethyl acetate (300 ml) then the layers were allowed to separate. The ethyl acetate layer was separated off and dried over magnesium sulphate, then the solvent was removed by distillation under reduced pressure to leave a pale brown liquid. The product, which weighed 44.9 g, was used without further purification.

2) Preparation of Coupler 18

A stirred solution of the β-ketoester (B) (49.0 g, 0.247 mol) and the aniline (C) (57.4 g, 0.169mol) in xylene (250 ml) was heated under reflux for 18 hours. The solution was cooled to 50° C. and petroleum-ether (bp 60°–80° C.) (100 ml) was added. A yellow precipitate was formed. The mixture was cooled to room temperature and the product was filtered off, washed with petroleum-ether (bp 60°–80° C.) and dried. The yield of coupler 18 was 55.2 g (74% based on the aniline).

EXAMPLE 2

Synthesis of Coupler 9

A 1 liter three-necked flask was charged with a solution of coupler 18 (55.2 g, 0.112 mol) in dichloromethane (400 ml). A solution of sulfuryl chloride (17.0 g, 0.126 mol) in dichloromethane (50 ml) was added over 30 minutes to the stirred solution at room temperature. The mixture was stirred for two hours then the solvent was removed by distillation under reduced pressure. The residual solid was recrystallised from a 1:2 mixture of ethyl acetate and petroleum-ether (bp 60°–80° C.) to give a pale yellow solid. The yield of coupler 9 was 47.7 g (81%).

EXAMPLE 3

Preparation of Coupler 1

Under an atmosphere of nitrogen, 1,1,3,3-tetramethylguanidine (24 ml, 0.19 mol) was added to a stirred solution of the hydantoin (D) (9.0 g, 0.385 mol) in acetonitrile (500 ml) at room temperature. After a few minutes, coupler 9 (22.1 g, 0.042 mol) was added to the stirred solution and the resulting mixture was heated at 60°–65° C. for 4.5 hours. The mixture was cooled to room temperature then it was poured into 3N hydrochloric acid (1 liter) and extracted with ethyl acetate (500 ml). The extract was washed with a saturated solution of sodium chloride then it was dried over magnesium sulphate. The solvent was removed by distillation under reduced pressure to give a brown oil, 32.0 g. The oil was purified by column chromatography on 63–200 mesh silica gel eluting with a 1:2 mixture of ethyl acetate and petroleum-ether (bp 60°–80° C.). Appropriate fractions afforded pure product as an orange gum, 18.5 g. The gum was dissolved in hot methanol (100 ml), then the solution was cooled to room temperature and left to stand for 20 hours. The resulting white solid was filtered off, washed with methanol and dried to give 16.1 g of coupler 1 (53%).

EXAMPLE 4

Synthesis of Coupler 6

Coupler 6 was synthesized as illustrated by the following sequence starting from 2-acetylthiophene.

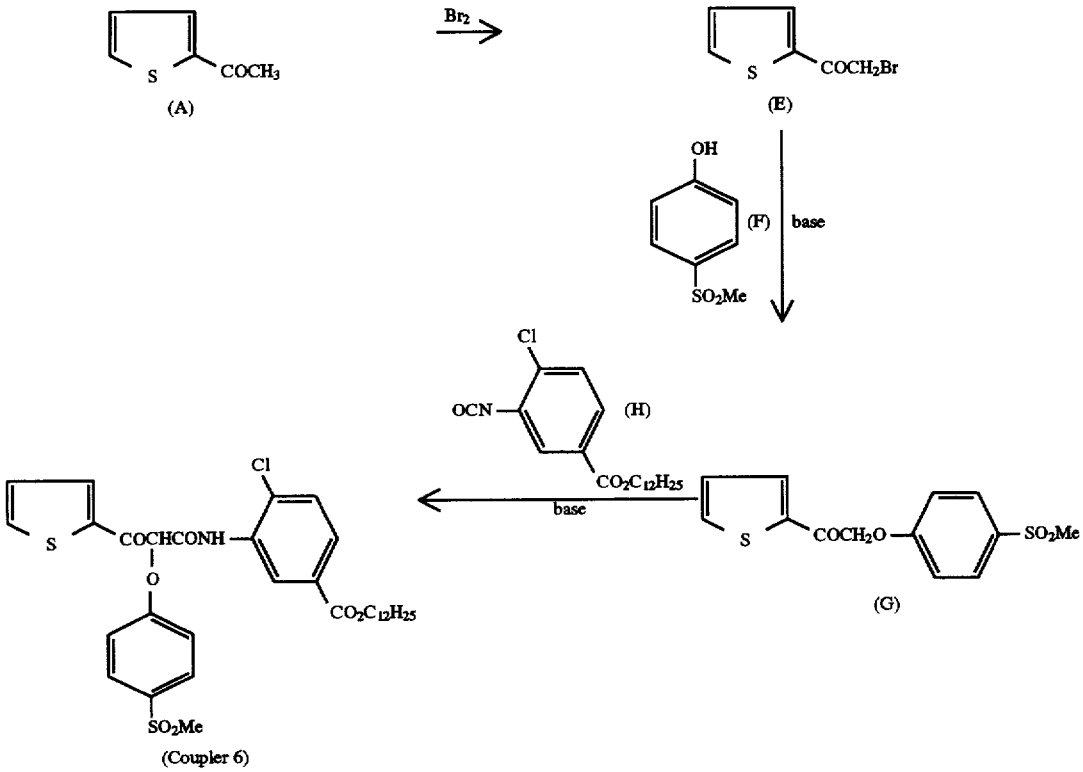

1) Preparation of Intermediate (E)

Bromine (16.3 g, 0.102 mol) was added over 15 minutes to a solution of 2-acetylthiophene (A) (12.6 g, 0.1 mol) in diethyl ether (120 ml), using an ice-bath to keep the temperature below 25° C. The reaction mixture was stirred for a further 10 minutes then it was shaken with water (100 ml). The ether layer was separated off and dried over magnesium sulphate, then the solvent was distilled off under reduced pressure. The resulting oil, which weighed 21.4 g, was used in the next stage without purification.

2) Preparation of Intermediate (G)

A mixture of intermediate (E) (4.2 g, 0204 mol), the phenol (F) (2.8 g, 0.0165 mol), tetrabutylammonium bromide (1.0 g), anhydrous potassium carbonate (6.0 g), toluene (60 ml) and water (60 ml) was stirred at room temperature for 1 hour. A further 0.4 g (0.002 mol) of the phenol (F) was added together with ethyl acetate (5 ml) and stirring was continued for 2 hours. The mixture was then added to 3N hydrochloric acid (50 ml) and this mixture was extracted with ethyl acetate (50 ml). The extract was dried over magnesium sulphate and the solvent was removed by distillation under reduced pressure. The residue was recrystallised from ethyl acetate (25 ml) to give a white solid, 3.3 g (59%).

3) Preparation of Coupler 6

A three-necked flask (250 ml) was charged with a solution of potassium t-butoxide (4.0 g, 0.0357 mol) in tetrahydrofuran (60 ml). The solution was cooled to 0° C. using an ice/acetone bath and the intermediate (G) (8.9 g,0.03 mol) was added portionwise to the stirred solution over 5 minutes keeping the temperature below 2° C. The resulting dark solution was stirred at 0°–5° C. for 10 minutes then a solution of the isocyanate (H) (11.2 g, 0.0308 mol) in tetrahydrofuran (20 ml) was added over 30 minutes keeping the temperature at 0°–3° C. The mixture was stirred for 1 hour then more isocyanate (H) (1.0 g, 0.002 mol) was added. After being stirred at a temperature of 0°–5° C. for a further 1 hour, the mixture was poured into 3N hydrochloric acid (200 ml) and this mixture was extracted with ethyl acetate (100 ml). The extract was washed with a saturated solution of sodium chloride and dried over magnesium sulphate, then the solvent was distilled off under reduced pressure to give a dark oil, 22.6 g. The oil was purified by column chromatography on 63–200 mesh silica gel eluting with a 1:3 mixture of ethyl acetate and petroleum-ether (bp 60°–80° C.) to give coupler 6 as an oil, 12.9 g (65%).

Couplers 4, 19 and 20 were synthesized as illustrated by the following sequence starting from 3-methoxy-thiophene.

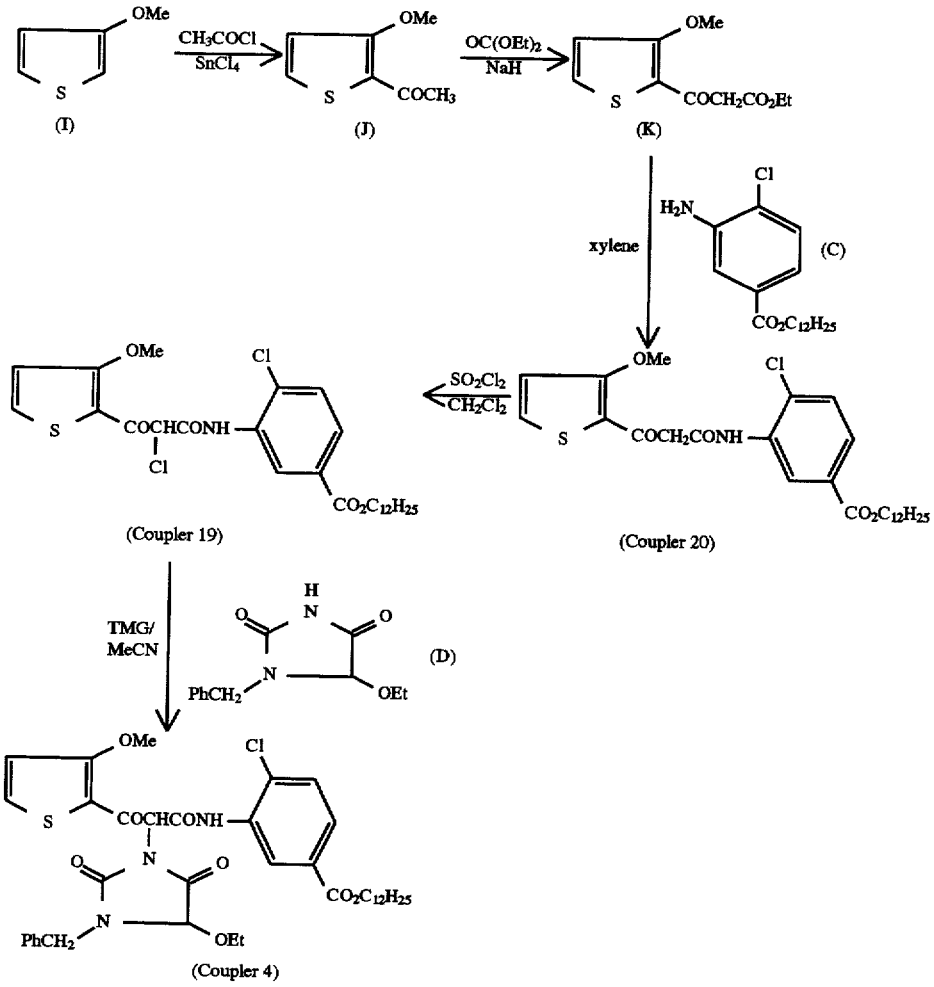

EXAMPLE 5

Synthesis of Couplers 4, 19 and 20

1) Preparation of Intermediate (J)

A solution of tin (IV) chloride (45.7 g, 0.175 mol) in dry toluene (60 ml) was added over 2 hours to a solution of commercially available 3-methoxythiophene (I) (20.0 g, 0.175 mol) and acetyl chloride (13.89, 0.175 mol) in toluene (300 ml). The mixture was stirred at room temperature for 18 hours then 3N hydrochloric acid (60 ml) was added together with diethyl ether (200 ml). The organic layer was separated off and the aqueous layer was extracted with three 200 ml portions of diethyl ether. The organic solutions were combined and were washed first with 2N sodium hydroxide solution (100 ml) and then with water (100 ml). The organic solution was dried over magnesium sulphate and the solvent was removed by distillation under reduced pressure. The resulting dark crystalline solid (25.5 g) was purified by column chromatography on 63–200 mesh silica gel eluting with a 1:2 mixture of ethyl acetate and petroleum-ether (bp 60°–80° C.). The product was obtained as orange crystals, 21.76 g (80%).

2)-5) Preparation of Couplers 4, 19 and 20

Couplers 4, 19 and 20 were prepared from 2-acetyl-3-methoxythiophene (J) using similar procedures to those used in the respective preparations of Couplers 1, 9 and 18.

PHOTOGRAPHIC EVALUATION OF YELLOW COUPLERS

The yellow couplers of the present invention (and control compounds) were dispersed in coupler solvent and incorporated into photographic coatings containing a silver bromoiodide emulsion, on a transparent support, according to the following coating diagram (amounts per square meter):

| | | |
|---|---|---|
| Gel Supercoat | Gelatin | 1.50 g |
| | Silver bromoiodide | 0.81 g |
| | Coupler | 1.932 mmol |
| Emulsion Layer | Gelatin | 2.42 g |
| | Bis(vinylsulfonyl)methane (hardener) | 0.06 g |
| Support | Cellulose acetate | |

Aqueous dispersions of the couplers were prepared by methods known in the art. The yellow dye-forming coupler dispersions contained 6% by weight of gelatin, 9% by weight of coupler and a 1.0:0.5:1.5 weight ratio of coupler to di-n-butyl phthalate coupler solvent to cyclohexanone auxiliary solvent. The auxiliary solvent was included to aid in dispersion preparation and was removed by washing the dispersion for 6 hours at 4° C. and pH 6.0.

(i) Sensitometric testing

The experimental photographic coatings prepared in this way were slit and chopped into 30 cm×35 mm test strips. After hardening the strips were exposed (1.0 sec) through a 0–4.0 neutral density step wedge (0.2 ND step increments)

and Daylight V. Wratten 35+38A filters and 0.3 ND filter then processed through a standard C-41 process as described in the British Journal of Photography Annual (1988) 196–198 using the following steps and process times:

| | |
|---|---|
| Developer | 2.5 minutes |
| Bleach | 4.0 minutes |
| Wash | 2.0 minutes |
| Fix | 4.0 minutes |
| Wash | 2.0 minutes |

For each test strip, Status M densities were measured as a function of exposure using a spectral array automatic transmission densitometer. Measurements of sensitometric parameters—maximum density (Dmax) and contrast (γ)—were obtained from plots of density vs. log exposure (DlogE curves).

In addition to the above standard conditions, separate strips of each coating were also developed in a competing process employing the same process steps as above but using a developer modified by the addition of 5.0 g/l citrazinic acid (CZA) and adjusted to pH 10.0 by the addition of sodium carbonate. The ratio of contrast in the competing process to contrast in the standard process (γCZA/γSTD) is quoted as an indication of in-film reactivity of the coupler.

(ii) Spectrophotometric testing 35 mm Test strips were exposed as above through a 0–0.9 ND step-wedge (0.3 ND increments) and Daylight V, Wratten 35+38A filters and the correct ND filters to give an optical density of about 1.0. The strips were processed using the standard conditions described above and samples cut from the yellow dye image step with density closest to 1.0. Visible absorption spectra of the resultant yellow dyes (normalised to 1.0 density) were obtained using a Pye-Unicam SP8-100 spectrophotometer. Dye hues are expressed in terms of the wavelength corresponding to the maximum absorption peak ($\lambda_{max}$) and the width of the curve at half the peak height, known as the half-bandwidth (HBW).

(iii) Dye stability testing

Yellow dye sample patches of density ca. 1.0 were prepared as for spectrophotometric testing and their absorption spectra measured as above.

Light stability testing: The dye sample patches, protected with a Wratten 2B gelatin filter, are faded for a period of 200 hours accumulated fade using a fadeometer in which the samples are mounted at a fixed distance of 4.0 cm from a pair of 85W, 6 ft long color matching fluorescent tubes maintained in strictly controlled conditions of 17° C. and 50% relative humidity.

Dark/wet stability testing: The dye sample patches are incubated in a dark oven for a period of 6 weeks accumulated fade at a constant 60° C. and 70% relative humidity.

In both cases the spectrophotometric curves are remeasured after the fade period and the degree of fade quoted as the fractional decrease in density at the wavelength of maximum absorption ($\lambda_{max}$) relative to the initial density prior to fading.

The results of the testing described above are set out in the following Tables 1 and 2:

TABLE 1

| COUPLER | Dmax | Contrast -γ | Reactivity $\gamma_{cza}/\gamma$ | λ max | HBW | LIGHT FADE 200 hrs | DARK/WET FADE 6 wks |
|---|---|---|---|---|---|---|---|
| Control 1 | 2.47 | 2.12 | 0.55 | 446 | 92.5 | −0.12 | −0.09 |
| Control 2 | 2.72 | 2.38 | 0.68 | 450 | 88.5 | −0.20 | −0.10 |
| Control 3 | 1.90 | 1.57 | 0.47 | 448.5 | 88 | −0.02 | −0.03 |
| Coupler 1 | 2.86 | 2.33 | 0.61 | 456 | 98 | −0.51 | −0.28 |
| Coupler 2 | 2.82 | 2.49 | 0.63 | 453 | 93 | −0.34 | −0.23 |
| Coupler 3 | 2.85 | 2.73 | 0.66 | 456.3 | 95 | −0.30 | −0.07 |
| Coupler 4 | 2.08 | 1.83 | 0.53 | 446 | 93 | −0.04 | −0.02 |
| Coupler 7 | 2.76 | 2.72 | 0.65 | 453 | 96 | −0.33 | −0.26 |
| Control 1 | 2.52 | 2.28 | 0.57 | 445.5 | 93 | −0.11 | −0.06 |
| Control 2 | 2.99 | 3.12 | 0.62 | 448 | 90 | −0.21 | −0.08 |

TABLE 2

| COUPLER | Dmax | Contrast -γ | Reactivity $\gamma_{cza}/\gamma$ | λ max | HBW | LIGHT FADE 200 hrs | DARK/WET FADE 6 wks |
|---|---|---|---|---|---|---|---|
| Control 1 | 2.63 | 2.18 | 0.57 | 447.5 | 96.5 | −0.03 | −0.01 |
| Control 2 | 2.86 | 2.69 | 0.65 | 450 | 91 | −0.15 | −0.17 |
| Control 3 | 2.28 | 1.72 | 0.56 | 448 | 87.5 | −0.01 | −0.01 |
| Coupler 1 | 2.87 | 2.46 | 0.59 | 456.5 | 95 | −0.45 | −0.31 |
| Coupler 2 | 2.85 | 2.70 | 0.63 | 452 | 92.5 | −0.31 | −0.28 |
| Coupler 5 | 2.54 | 2.13 | 0.47 | 452.5 | 90 | −0.42 | −0.43 |
| Coupler 6 | 2.79 | 2.59 | 0.69 | 456.5 | 105 | −0.56 | −0.33 |
| Control 1 | 2.58 | 2.08 | 0.60 | 448.5 | 97 | −0.05 | +0.04 |
| Control 2 | 2.81 | 2.67 | 0.61 | 451 | 90 | −0.14 | −0.18 |

Couplers 1 to 43 have the structures described above. The chemical structures of Controls 1, 2 and 3 are as follows:

Control 1

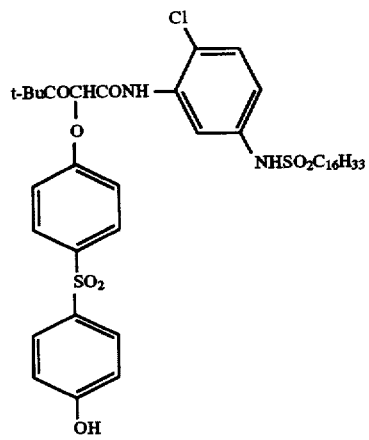

Control 2

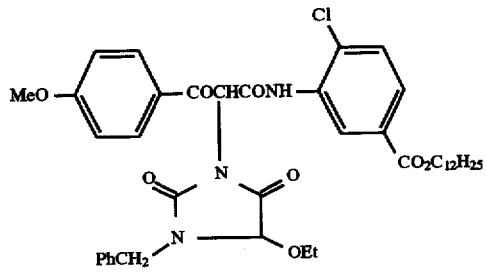

-continued

Control 3

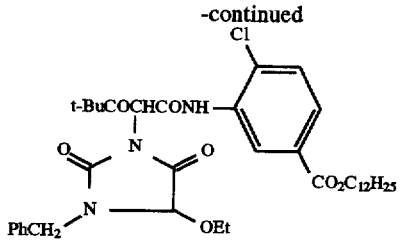

From the above, it will be seen that the yellow couplers, in accordance with the present invention as hereinbefore described, have properties which are comparable or better than the control couplers which are used in commercially available photographic materials. In particular, Coupler 3 exhibits a Dmax and contrast which, in each case, is greater than the corresponding parameters of the three control couplers, and Coupler 4 exhibits good light fade and dark/wet fade properties.

The entire contents of the various patent applications, patents and other publications referred to in this specification are incorporated herein by reference.

What is claimed is:

1. A photographic element comprising a light-sensitive silver halide emulsion layer having associated therewith a dye-forming coupler of formula (I):

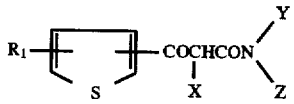

(I)

wherein X is H or a coupling-off group, $R_1$ is a substituent group; Y and Z are the same or different and are H or are independently selected from alkyl, aryl and heteroaryl groups; provided that Y and Z taken together with the nitrogen atom may form a 5–10 membered heterocyclic ring.

2. The element of claim 1 wherein the coupler has formula (II):

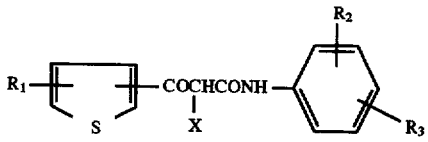

(II)

wherein $R_2$ and $R_3$ are H or are independently selected substituent groups.

3. The element of claim 2 wherein the coupler has formula (III):

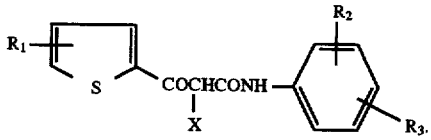

(III)

4. The element of claim 2 wherein the coupler has formula (IV):

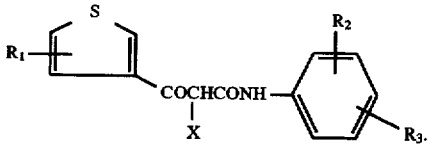

(IV)

5. The element of claim 2 wherein $R_1$ is selected from coupler-solubilising groups, ballasting groups and dye hue-modifying groups, and $R_2$ and $R_3$ are selected, independently, from H, coupler-solubilising groups, ballasting groups and dye hue-modifying groups.

6. The element of claim 2 wherein $R_1$, is selected from halogen, alkyl, aryl, heteroaryl, carboxylic acid, oxycarbonyl, amido, sulfonamido, amino, alkoxy, aryloxy, acyloxy, carbamoyl, sulfamoyl, sulfonyl, and sulfonyloxy groups and $R_2$ and $R_3$ are independently selected from the groups suitable for $R_1$ and H.

7. The element of claim 2 wherein at least one of $R_1$, $R_2$ and $R_3$ contains at least six carbon atoms.

8. The element of claim 1 wherein $R_1$ is selected from halogen, alkyl, alkoxy, alkylsulfonyloxy, alkylsulfonamido and alkoxycarbonyl groups.

9. The element of claim 2 wherein $R_2$ is selected from halogen, alkoxy and trifluoromethyl groups.

10. The element of claim 1 wherein the coupler has the formula:

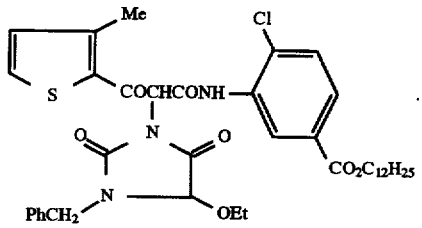

11. The element of claim 1 wherein the coupler has the formula:

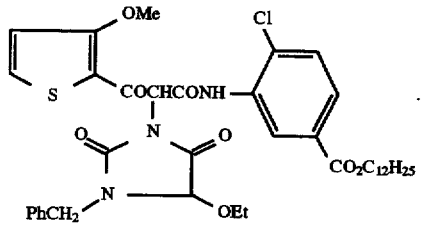

12. A multicolor photographic material comprising a support bearing yellow, magenta and cyan image-dye-forming units comprising, respectively, at least one blue-, green- or red-sensitive silver halide emulsion layer each having associated therewith at least one yellow, magenta or cyan dye-forming coupler respectively, wherein at least one dye-forming coupler is a coupler as claimed in claim 1.

13. A method of forming an image in the element of claim 1 after the element has been imagewise exposed to light, comprising contacting the element with a color developing agent.

14. A photographic element comprising a light-sensitive silver halide emulsion layer having associated therewith a dye-forming coupler of formula (IV):

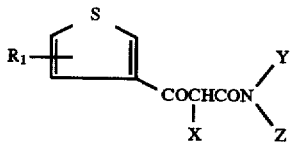

wherein X is H or a coupling-off group, $R_1$ is H or a substituent group; Y and Z are the same or different and are H or are independently selected from alkyl, aryl and heteroaryl groups; provided that Y and Z taken together with the nitrogen atom may form a 5–10 membered heterocyclic ring.

15. A photographic element as in claim 15 comprising a dye-forming coupler of formula (IV):

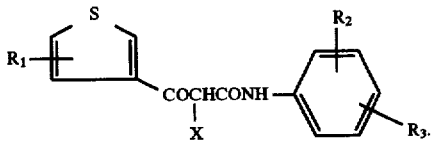

(IV)

wherein $R_2$ and $R_3$ are H or are independently selected substituent groups and the other substituents are as in claim 14.

16. The element of claim 15 wherein $R_1$, $R_2$ and $R_3$ are selected, independently, from H, coupler-solubilising groups, ballasting groups and dye hue-modifying groups.

17. The element of claim 15 wherein $R_1$, $R_2$ and $R_3$ are independently selected from H, halogen, alkyl, aryl, heteroaryl, carboxylic acid, oxycarbonyl, amido, sulfonamido, amino, alkoxy, aryloxy, acyloxy, carbamoyl, sulfamoyl, sulfonyl, and sulfonyloxy groups.

18. The element of claim 15 wherein at least one of $R_1$, $R_2$ and $R_3$ contains at least six carbon atoms.

19. The element of claim 14 wherein $R_1$ is selected from H, halogen, alkyl, alkoxy, alkylsulfonyloxy, alkylsulfonamido and alkoxycarbonyl groups.

* * * * *